US006173455B1

(12) United States Patent
Nordstrom

(10) Patent No.: US 6,173,455 B1
(45) Date of Patent: Jan. 16, 2001

(54) SHOWER DRAIN HAIR TRAP

(76) Inventor: Anette Viola Nordstrom, 1609 Atlantic Ave., Fernandina Beach, FL (US) 32034

( * ) Notice: Under 35 U.S.C. 154(b), the term of this patent shall be extended for 0 days.

(21) Appl. No.: 09/488,743

(22) Filed: Jan. 20, 2000

(51) Int. Cl.[7] ..... E03C 1/264
(52) U.S. Cl. ..... 4/292
(58) Field of Search ..... 4/286, 287, 292

(56) References Cited

U.S. PATENT DOCUMENTS 417,636 * 12/1889 Forth ..... 4/287 X
1,203,530 * 10/1916 Gessler ..... 4/287 X
3,314,086 * 4/1967 Minella ..... 4/287 X
5,099,527 * 3/1992 Roose ..... 4/255.11
5,297,399 * 3/1994 Wilson ..... 4/292 X

FOREIGN PATENT DOCUMENTS

156338 * 1/1921 (GB) ..... 4/287

* cited by examiner

*Primary Examiner*—Robert M. Fetsuga

(57) ABSTRACT

A new article of a smooth, durable, flexible fiberglass screen mesh material. The screen is placed over and around an open conventional pop-up stopper, for preventing hair, and other debris from entering and clogging the drainpipes of bathtubs, lavatories and the like.

2 Claims, 2 Drawing Sheets

SHOWER DRAIN HAIR TRAP

BACKGROUND OF INVENTION

1. Field of the Invention

This invention is a new improvement to an old problem of drain cloggings caused by hair and other debris washed into drain openings. This is a new improvement, with the use of a domestic fiberglass screen material.

This new invention is to maintain the pop-up stopper in its original place. The stopper does not have to be altered or removed to accommodate this new device.

A screen, without the use of any support members or other devices.

2. Description of Prior Art

Prior inventions illustrate various attachments and devices for holding and securing screen in a drain opening.

SUMMARY OF INVENTION

The present invention is directed to a disposable inexpensive drain hair trap, related in general to plumbing fixtures having a pop-up stoppered drains. This new improvement of a device for the prevention of clogging drainpipes of bathtubs, sinks, and the like, caused by hair and other debris washed into a drain opening.

This is a gentle to handle smooth, flexible, and rustproof fiberglass wire mesh screen, with the resistance to fraying. The screen have the necessary stiffness to stay in place and allow for a free flow of water into the drainpipe opening.

A specific center opening with specific cuts makes for a tangling and trapping effect upon loose hair strands and other debris when taking a shower, washing, and the like.

The screen is easily placed over and around a conventional open pop-up stopper. Secured in place by the vertical part under the horizontal top portion of the stopper, the majority part of the round screen is resting on the tub floor surface.

This fiberglass screen makes for a quick and easy removal of hair, lint, and the like. This article is to be used in households settings and makes for an inexpensive enough device to be replaced after each usage in such places such as hotels and the like.

DETAILED DESCRIPTION OF THE PREFERRED EMBODIMENTS

Figure 1:
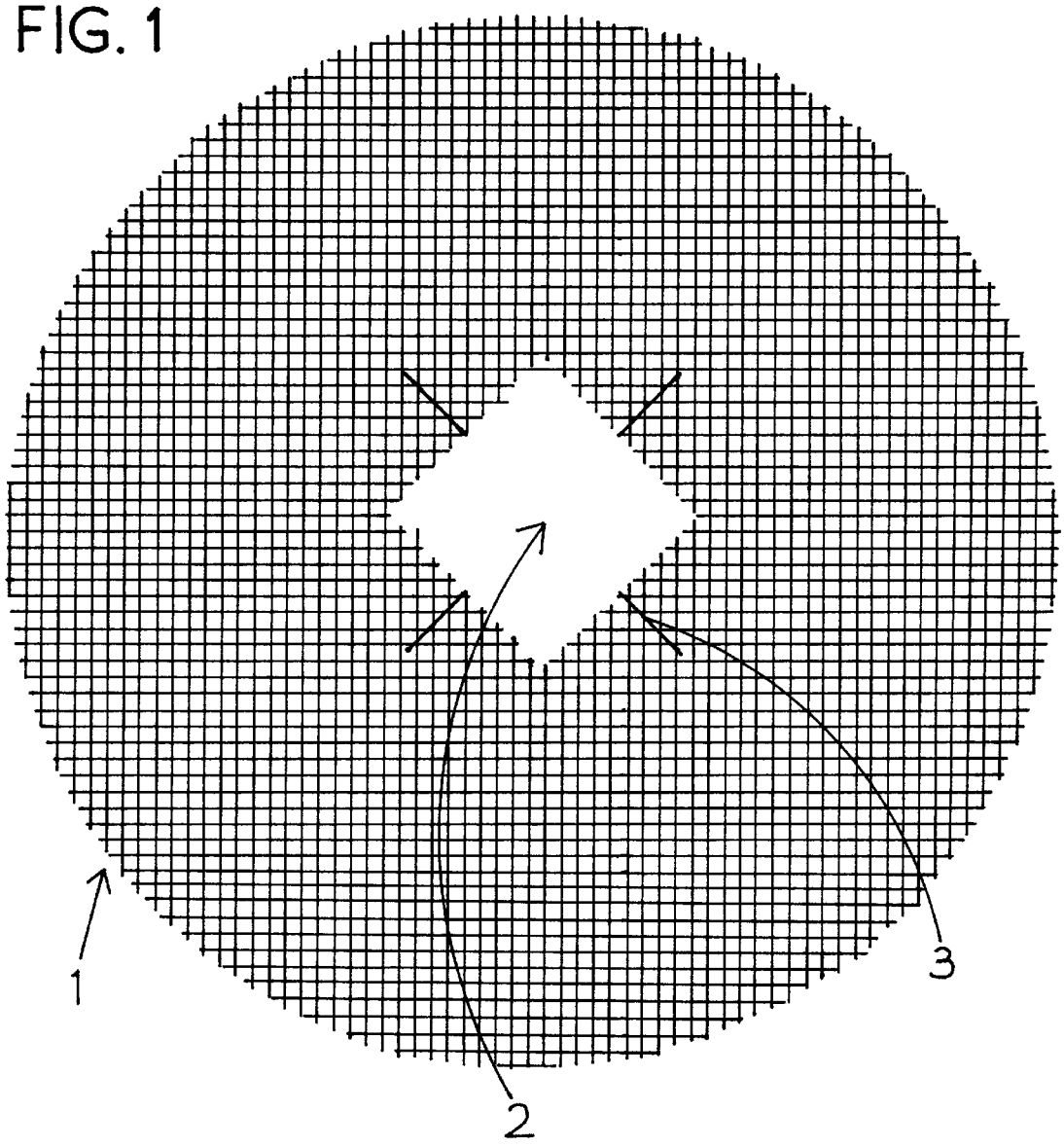
FIG. 1 is a plan view of a drain hair trap

Referring now to the drawings for purposes of illustration the preferred embodiments of the present invention only and not for purposes of limiting the same. The Figures show a drain hair trap generally designated for preventing the passage of hair and debris into a drain opening having a lifted open conventional pop-up stopper (not shown).

FIG. 1 is a fiberglass screen made of a flexible woven thread mesh netting material. This circular screen is approximately ½ mm to ¼ mm thick and preferably approximately 5 inches in diameter. In my findings this is the best suitable material for the purpose.

The screen makes for a complete contact with the tub floor surface (not shown), without making any damage to the surface in a tub, sink, and the like. This screen is used for its durability and allows for a free flow of water there through into a drain opening. A flexible screen that can easily be folded into halves for a quick and easy removal of trapped hair, lint, and the like. Any other equally suitable material may also be used.

The jagged outer perimeter I makes for the trapping of hair and lint. A square opening 2, in the center of the screen is preferably approximately 1 inch. Four cuts are made in the center of the mesh 3, in the center of each side of the square. The lengths of the cuts are preferably approximately ⅜ of an inch. The jagged edges in the center square the square 2 combined with the jagged edges on the cuts 3, makes for trapping of hair, lint, and the like.

Center square opening 2 and cuts 3, are made diagonal to the squares in the fiberglass mesh. Any other similar cuts and opening may also be used.

Figure 2:
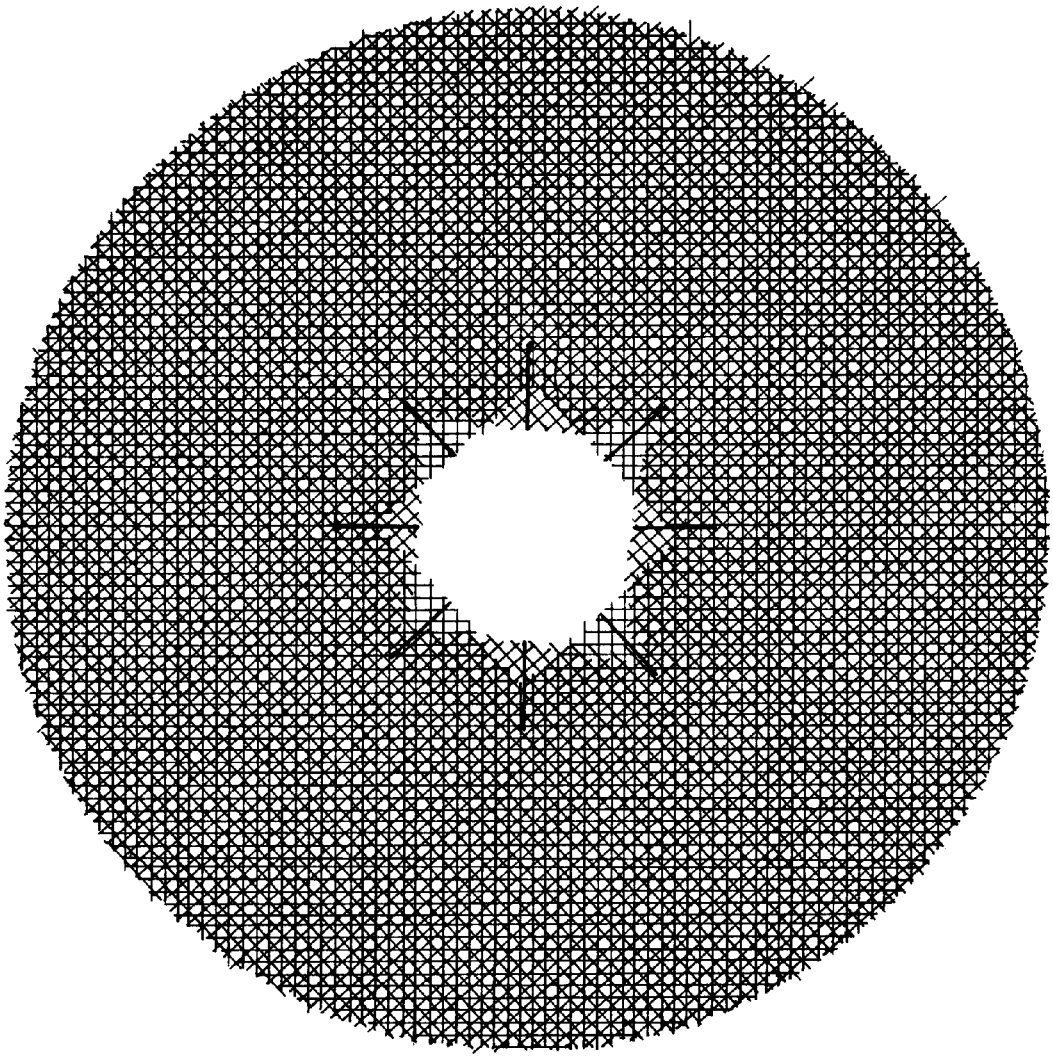
FIG. 2 is a plan view of two coinciding drain hair traps

FIG. 2 is two screens together with the perimeter coinciding. Overlapping of cuts and square is not at all necessary.

All the dimensions of the article of the present invention should be adapted to the different sizes of pop-up stoppers and drain openings of bathtubs, lavatories, and the like.

While the present invention has been described in many modifications and variations will be readily apparent to those of ordinary skill in the art. This disclosure and the claims are intended to cover all such modifications and variations.

What I claim as my invention is:

1. A drain hair trap for preventing the passage of hair and debris from entering into a drain opening in a bathtub, sink, and the like, having a conventional liftable stopper and a flange, comprising:

said drain hair trap is constructed of a durable, flexible fiberglass screen mesh material, said material makes for a free passage of water therethrough into a drain opening;

a removable circular flat disk of said material having an outer diameter substantially larger than the top horizontal portion of said stopper, extending outwardly on the tub floor surface and cover the greater area under an open said stopper;

said fiberglass screen have a center square opening made diagonal to the squares in said fiberglass mesh.

2. A drain hair trap of claim 1 wherein said center square opening have a cut in the middle of each side of said center square opening, these said cuts are also made diagonal to the squares in said fiberglass screen mesh. This allows for a gripping action on loose hair strands, comprising:

a plurality of said screens with said opening and said cuts corresponding in size to said stopper, makes for a greater affect over said gripping action and said screens are easily placed over, around and under said lifted stopper.

* * * * *